US007030896B2

(12) United States Patent
Igarashi et al.

(10) Patent No.: US 7,030,896 B2
(45) Date of Patent: Apr. 18, 2006

(54) PRINTING SYSTEM USING THERMAL PRINTER

(75) Inventors: Mitsuhiro Igarashi, Kanagawa (JP); Kei Suzuki, Kanagawa (JP); Takeo Miyajima, Kanagawa (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

(21) Appl. No.: 10/413,484

(22) Filed: Apr. 15, 2003

(65) Prior Publication Data

US 2005/0041090 A1 Feb. 24, 2005

(30) Foreign Application Priority Data

Mar. 3, 2003 (JP) ..... 2003-055382

(51) Int. Cl.
*B41J 2/52* (2006.01)

(52) U.S. Cl. ..... 347/171; 347/183

(58) Field of Classification Search ..... 347/171–176, 347/183; 400/61, 76; 358/3.01, 3.02, 1.1, 358/1.8

See application file for complete search history.

(56) References Cited

U.S. PATENT DOCUMENTS 6,351,275 B1 * 2/2002 Ayling et al. ..... 347/171
6,682,239 B1 * 1/2004 Mori et al. ..... 400/649

FOREIGN PATENT DOCUMENTS

JP 09-226184 A 9/1997
JP 2000-206957 * 7/2000

* cited by examiner

*Primary Examiner*—Huan Tran
(74) *Attorney, Agent, or Firm*—Sughrue Mion, PLLC

(57) ABSTRACT

A printing system using a thermal printer capable of readily visually discriminating the background data and sales data, saving waste of paper resources and improving the printing speed is provided. When printing basic data and background data in superimposition on each other in a thermal printer having a matrix array of color generation dots, data representing density gradation values are supplied to each color generation dot for printing background data with density lower than the density of the basic data. The direction of the basic data is set to a direction different by 90 degrees, for instance, from the direction of the array of the basic data. The visual discrimination of the two different kinds of data is improved.

15 Claims, 9 Drawing Sheets

領収書
山田 太郎 様
¥2,005
(消費税95円を含みます)
但し、食品代として
2003年3月1日 上記正に領収いたしました。
株式会社××× △△店 03-○○○○-□□□□
本社 〒XXX-XXXX 東京都☆☆区▽▽ Z-ZZ-ZZ

DATA SEQUENCE DIAGRAM

FIG.5

RECEIPT STAMP

| | | |
|---|---|---|
| A弁当 | | ¥500 |
| A弁当 | | ¥600 |
| C弁当 | | ¥450 |
| お茶 | | ¥120 |
| 缶コーヒーA | | ¥120 |
| 缶コーヒーB | | ¥120 |
| 小計 | | ¥1, 910 |
| 消費税 | 5% | ¥95 |
| 合計 | | ¥2, 005 |
| 預り | | ¥2, 100 |
| 釣り | | ¥95 |

ありがとうございました。

店舗スタッフ募集

FIG.6

PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM
PLE SAMPLE SAMPLE SAMPLE SAMPLE SAMPLE SAMPLE SAMPLE
SAMPLE SAMPLE SAMPLE SAMPLE SAMPLE SAMPLE SAMPLE SAM

FIG.7

RECEIPT STAMP

A弁当 ¥500
A弁当 ¥600
C弁当 ¥450
お茶 ¥120
缶コーヒーA ¥120
缶コーヒーB ¥120
小計 ¥1,910
消費税 5% ¥95
合計 ¥2,005
預り ¥2,100
釣り ¥95

ありがとうございました

店舗スタッフ
募集

FIG.8

領収書

山田　太郎　様

￥2,005

（消費税95円を含みます）

但し、食品代として

2003年3月1日　上記正に領収いたしました。

株式会社×××　△△店　03−○○○○−□□□□

本社　〒XXX−XXXX　東京都☆☆区▽▽　Z−ZZ−ZZ

SAMPLE

PRINTING SYSTEM USING THERMAL PRINTER

BACKGROUND OF THE INVENTION

1. Technical Field of the Invention

The present invention relates to a printing system using a thermal printer and, more particularly, to a printing system using a thermal printer capable of printing background data such as to be visually clearly distinguished from also printed basic data.

2. Background of the Invention

The POS system permits various data such as sales data to be obtained in real time and is widely used in various shops such as convenience stores, supermarkets, restaurants and fast-food restraint in view point of sales tactics. The POS system is also used for printing ticket sheets for entrance tickets of concerts, attractions, etc., train tickets and airplane tickets.

In the POS system of this type, a bar code reader in each POS terminal reads out bar cods printed on sales items, thus taking out sales item data and item price data, or each register operator inputs item data and price data by terminal operation. The data taken out or inputted in this way, are fed out from the terminal to a processor as main unit for the execution of POS functions such as item management and sales amount management.

For recording details of sales data such as sales items and amounts, sales data are printed on each receipt by a printer provided with the terminal. Among the data printed on the receipt, are usually item name, unit price, total amount, consumption tax, gross total amount, deposited amount, change amount and date and are also shop data such as shop name. In the meantime, it has been largely desired and put to actual practice to additionally print particular data such as shop design marks and service messages on the receipts.

In the prior art printing on this type of receipts, the particular data are printed in fixed independent areas separate from item sales data on the receipt.

Japanese patent laid-open No. 9-226184 (FIG. 2, paragraphs [0015]–[00021]) (Patent reference 1) discloses a receipt printing system, in which when printing a shop name or like shop mark together with character data on the receipt, the shop mark image data which requires a long printing time is preliminarily read out. This system is an example of printing the shop mark in an independent place separate from item sales data.

In the meantime, printing of particular data as background data in superimposition on sales data as genuine basic data, is desired because of its capability of reduction of the paper quantity used and also reduction of the printing time. However, the printing of the two kinds of data in superimposition on each other, poses a problem that the visual recognition property of the genuine basic data is extremely deteriorated.

Also, the printer provided with the POS terminal used in the POS system should be inexpensive in price. For this reason, thermal printers are used. The prior art thermal printers, however, use a matrix array of color generation dots. Therefore, fine print density adjustment cannot be obtained, and print of basic data and background data and in superimposition on each other results in extreme deterioration of the visual recognition property of the two kinds of data.

FIG. 9 shows dot diagrams for explaining print examples based on an area gradation system using a prior art thermal printer. Referring to FIG. 9, data are printed by causing color generation of each of 8 by 8 dots as a unit. In the density expression printing by the prior art thermal printer, the density adjustment is performed by adjusting the number of color generation dots per unit area of the basis of this area gradation system. By way of example, FIG. 9(A) shows a high density expression case. In this case, all the dots are caused to generate color. FIG. 9(B) shows a low density expression case. In this case, substantially one half of the full dots are caused to generate color. FIG. 9(C) shows a medium density expression case. In this case, color generation of dots is caused in an adequate balance.

However, the density printing based on such area gradation is subject to a restriction that the print is very uncomforably viewed in case when a large number of gradations are provided for a small area.

SUMMARY OF THE INVENTION

The present invention was made in view of the above background affairs, and it has an object of providing a printing system using a thermal printer capable of readily visually discriminating two kinds of data, i.e., background data such as shop mark and sales data, from each other.

Another object of the present invention is to provide a print system using a thermal printer capable of saving waste of paper resources and improving the printing speed.

In order to solve the above problems, a print system using a thermal printer according to the present invention has the following featured structures.

(1) According to an embodiment of the invention, a printing system using a thermal printer has a matrix array of color generation dots for printing basic data and background data in superimposition on each other in the thermal printer, wherein data representing density gradation values are supplied to each color generation dot to let the background data be printed with a density lower than the density of the basic data.

(2) According to another embodiment, in a printing system using a thermal printer according to the invention, the direction of the background data is set to a direction from the direction different from the direction of the array of the basic data.

(3) According to another embodiment, in a printing system using a thermal printer according to the invention, the direction of the background data is set to a direction different by 90 degrees from the direction of array of the basic data.

(4) According to yet another embodiment, in a printing system using a thermal printer according to the invention, the background data is registered as data of a predetermined gradation number in the printer for printing with a predetermined density on the basis of the density of the basic data.

(5) According to yet another embodiment, in a printing system using a thermal printer according to the invention, the printing is performed by a printer in a POS terminal.

According to yet another embodiment, in a printing system using a thermal printer according to the invention, the printing is made on receipts, train tickets, airplane tickets or entrance tickets.

Preferred embodiments of a printing system using a thermal printer according to the present invention will now be described with reference to the drawings.

BRIEF DESCRIPTION OF THE DRAWINGS

FIG. 5 is an example of a prior art receipt.

FIG. 6 is an example of receipt sheet on which "SAMPLE" are printed as background data on the receipt sheet.

FIG. 7 is an example of receipt sheet on which the background data shown in FIG. 6 is printed in superimposition on the receipt sheet shown in FIG. 5.

FIG. 8 is an example of a finally obtained horizontally elongate receipt sheet on which the background data is printed in superimposition.

DETAILED DESCRIPTION OF THE INVENTION

In the present invention, for solving the problem in the thermal printer that fine print density adjustment cannot be obtained, a density gradation system to be described later is adopted to provide shades in color generation dots. Thus, the restriction as in the prior art is precluded, thus greatly expanding the scope of applications of the printing.

Figure 1:
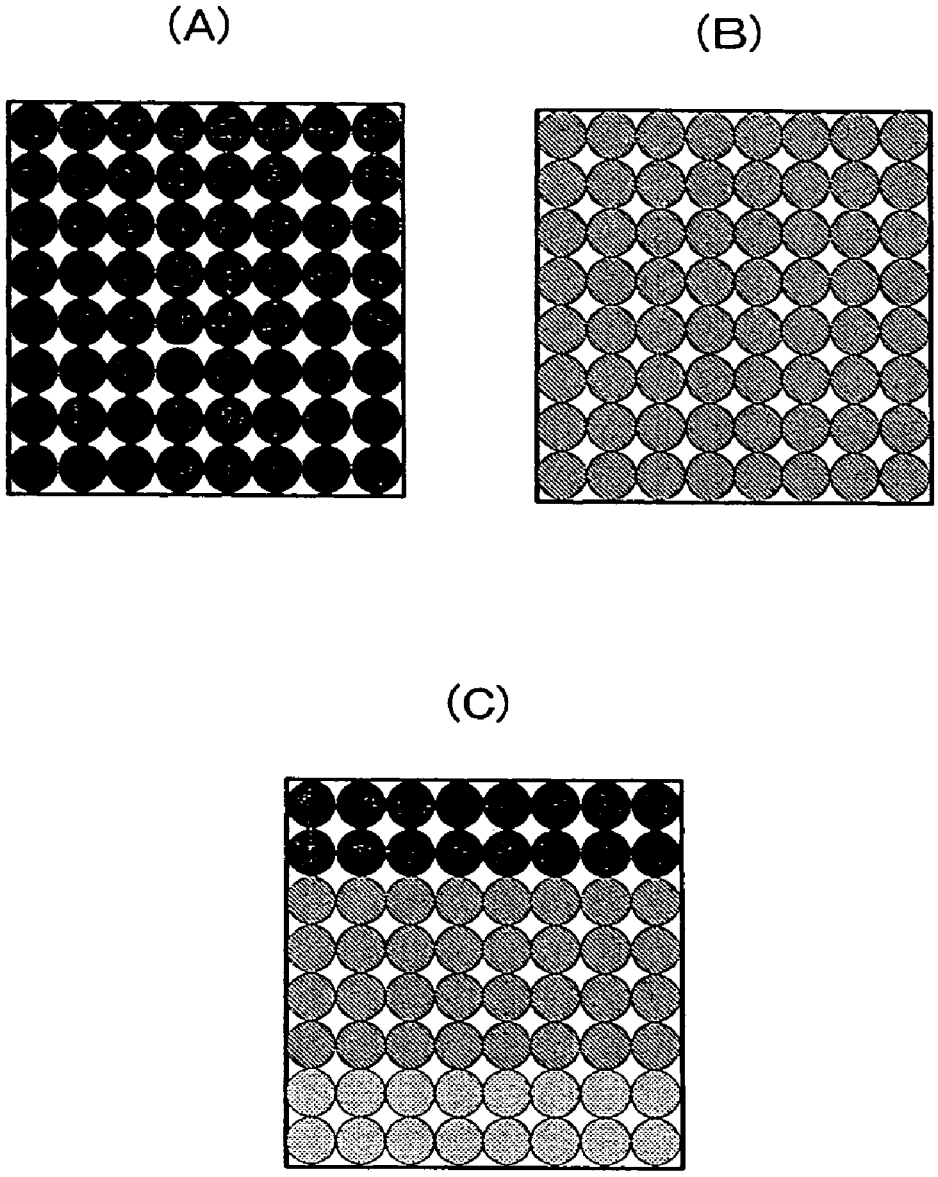
FIG. 1 shows dot diagrams for describing the basic principle of the printing system by a thermal printer according to the present invention.
Figure 9:
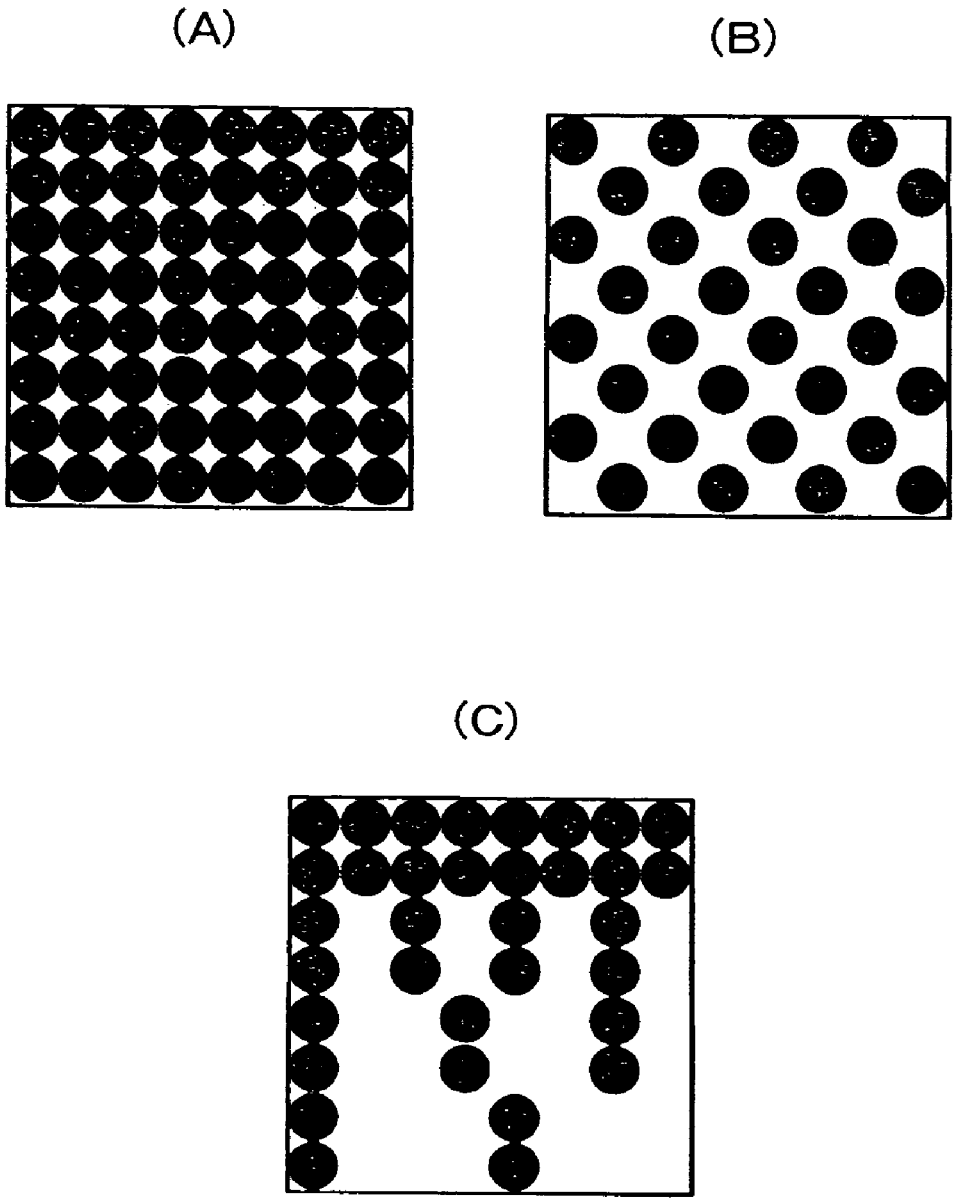
FIG. 9 are drawings for describing the area gradation system by a prior art thermal printer.

FIG. 1 shows dot diagrams for describing the density gradation system according to the present invention, representing dot states of high density, low density and medium gradation density like those in FIG. 9, respectively. FIG. 1(A) shows a state of expression with the highest density. In this case, all the dots are caused to generate color with the highest density. FIG. 1(B) shows a state of expression with low density. In this case, all the dots are caused to generate color with a low density. FIG. 1(C) shows a state, in which the dots in the two upper rows are caused to generate color with the highest density. The dots in the subsequent four rows are caused to generate color with a medium density, and the dots in the two lower rows are caused to generate color with a low density.

In the present invention, background data printing is performed based on the density gradation printing system instead of area gradation system. For example, activation control which permit desired gradation differences to be obtained without taking the physical transfer time to the thermal head, is performed by preliminarily judging gradation values expressed in gray scale and adequately changing part of actuation time which is weighted for each bit.

In the present invention, background data capable of being expressed in density gradations are preliminarily registered by, for instance, a receipt issuance printer connected to a POS system, and when the receipt detail data gradation number is smaller than the registered density gradation number of the background data, or when purely monochromic receipt detail data is transmitted, the background data and the receipt detail data are printed in superimposition on each other on the printer side.

Figure 2:
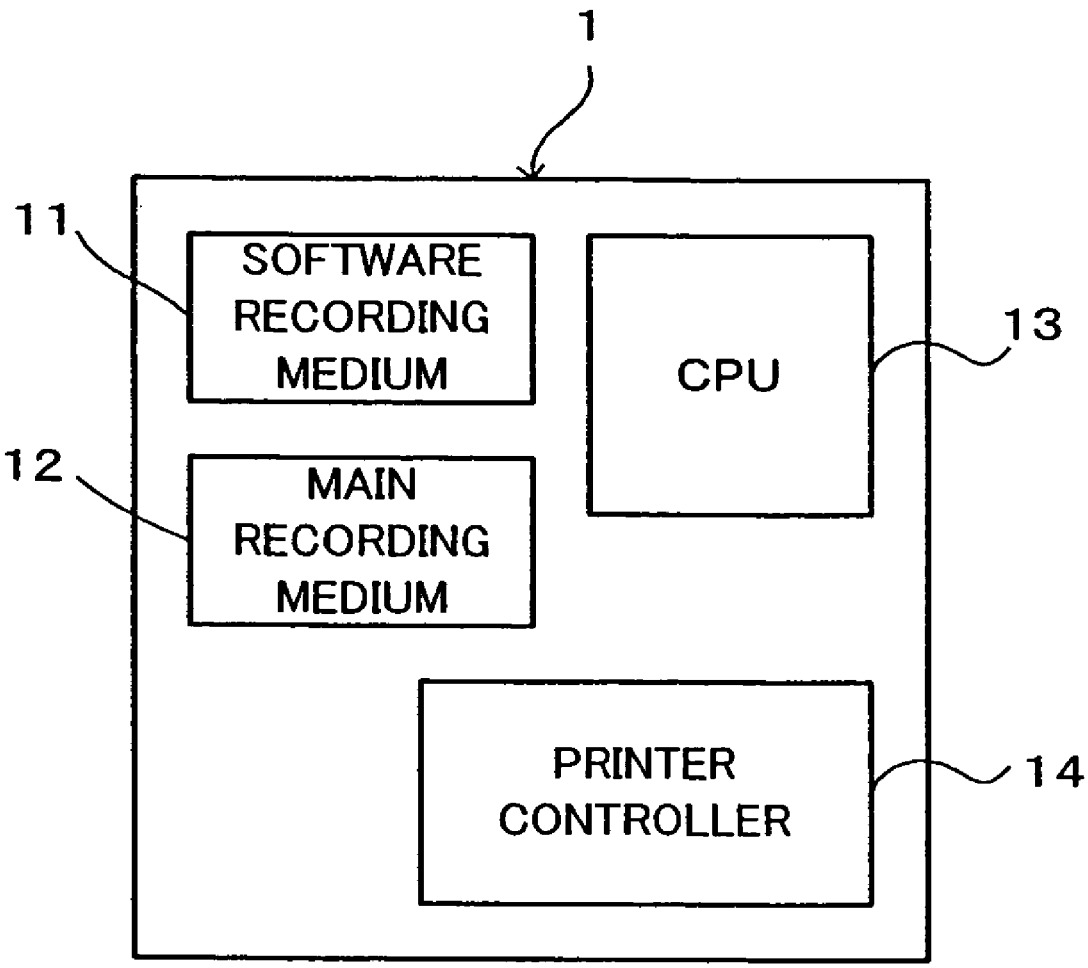
FIG. 2 is a block diagram showing the construction of a printer 1 according to an embodiment of the present invention.
Figure 3:
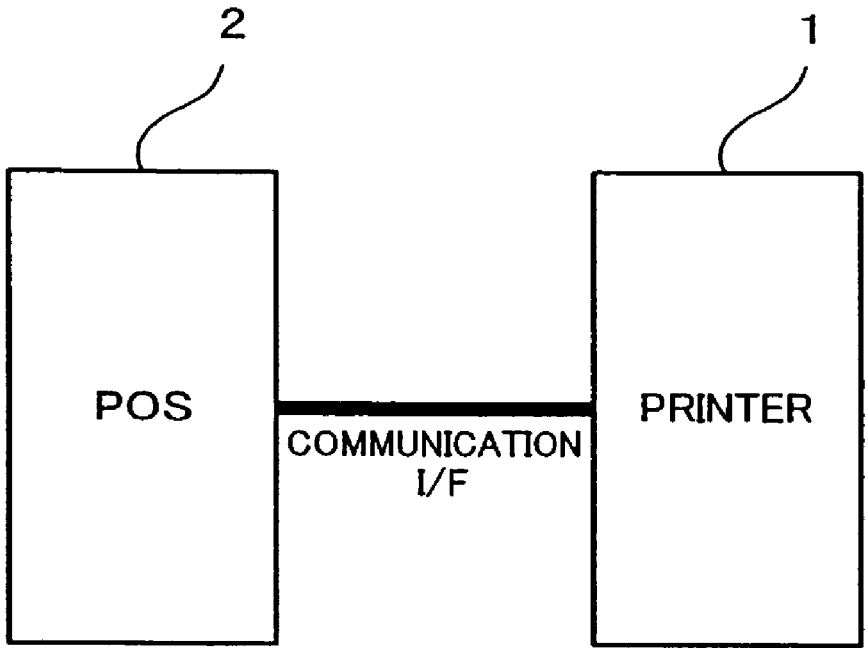
FIG. 3 is a connection construction of the printer 1 and the POS terminal 2 according to the present invention.

FIG. 2 is a block diagram showing the construction of a printer 1 as an embodiment of the present invention. The printer 1 comprises a software recording medium 11, a main recording medium 12, a CPU 13 and a printer controller 14. As shown in FIG. 3, the printer is connected via a communication interface (I/F) to the POS terminal 2.

Figure 4:
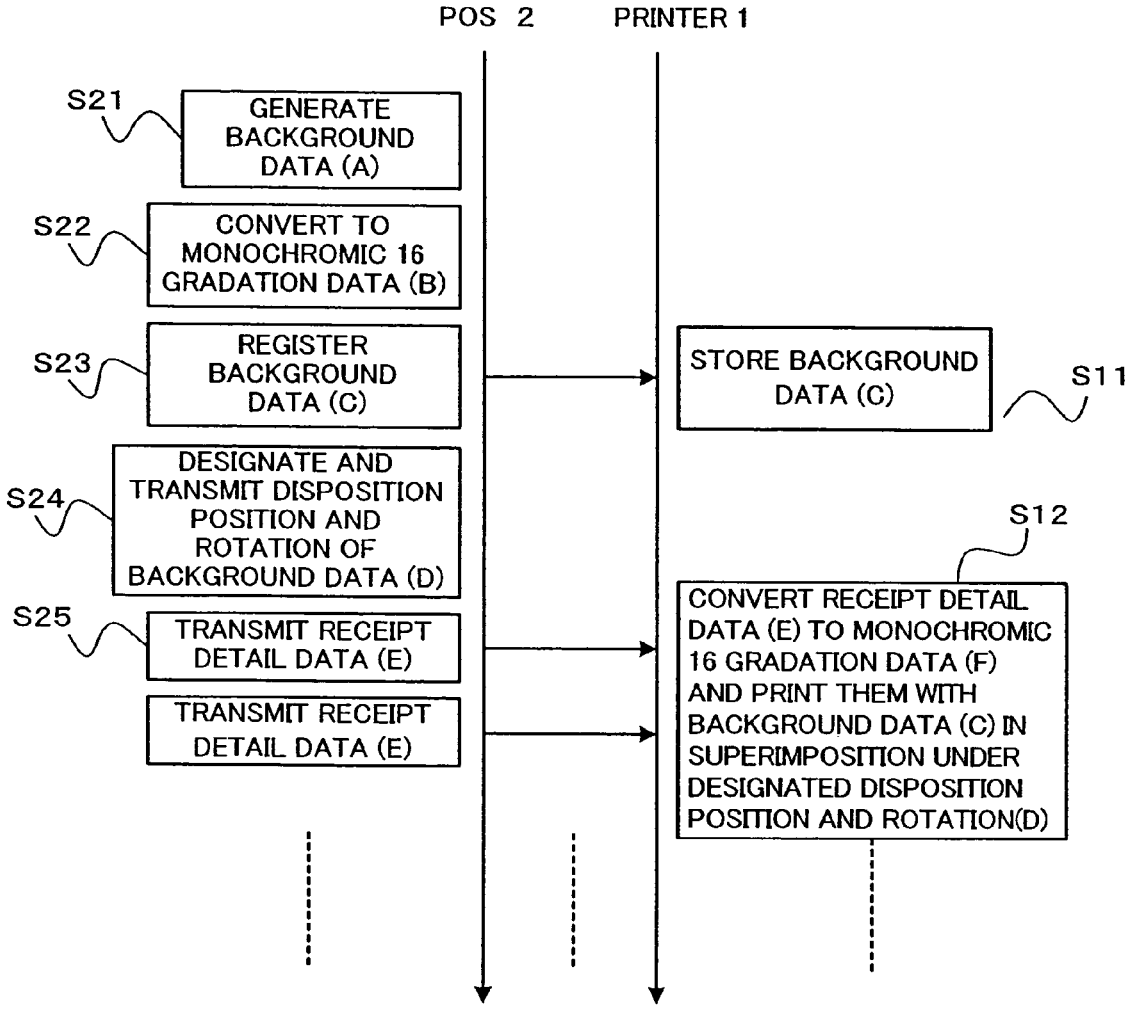
FIG. 4 is a data sequence diagram for describing the basic principle of the printing system by a thermal printer according to the present invention.

Now, the operation of an embodiment of the present invention will be described with reference to FIG. 4 showing data sequence.

First, background data (A) is generated on the side of the POS terminal 2 (step S21). As the background data, photographs and illustrations can be used. Here, letters "SAMPLE", for instance, is used as an example of the background data. The background data (A) is converted to data (B) 4 bits per one dot capable of being expressed as monochromic 16 gradations (step S22) and then registered as background data (C) in a printer (step S23). On the side of the printer 1, the received background data (C) are stored in the software recording medium 11 or the main recording medium 12 (step S11). For the printing of the background data, data (D) designating the disposition position and rotation (or direction) are transmitted (step S24). The designation of the disposition position and the rotation (or direction) is for presetting a predetermined condition (i.e., rotation) for visually readily discriminating the background data to the relation to the disposition position and the direction represented by the receipt detail data.

When the receipt detail data (E) is transmitted from the POS terminal 1 to the printer 1 (step 25), on the side of the printer 1 a step S12 is executed, in which the receipt detail data (E) is converted to the monochromic 16-gradation data (F), and the background data (C) is printed under the condition of the designated data (D) transmitted from the POS terminal 1.

As for the setting of the disposition position and rotation, in the case of, for instance, vertically elongate receipt data as shown in FIG. 5, the letter row is arranged in the horizontal direction, and thus by arranging background data "SAMPLE" on the vertical direction, the two different letter groups can be readily visually distinguished from each other. Subsequently, the position of the letters "SAMPLE" is appropriately set and rotated by 90 degrees, and printing is performed as shown in FIG. 6. The above shade gradation data, which is obtained by combining the receipt detail data and the background data "SAMPLE" in the above way, is printed by the printer 1, whereby a receipt sheet with additional background data as shown in FIG. 7 is obtainable.

In the case of printing the background data "SAMPLE" in superimposition on a horizontally elongate receipt data as shown in FIG. 8, the background data "SAMPLE" is likewise set to be at a predetermined position by 90 degrees so that the letter rows of the receipt data and the background data "SAMPLE" are deviated in direction by 90 degrees.

The designation of the rotation of the background data and the setting of the disposition position is made in the form of commands or the like from the POS terminal 2. The printer 1 performs printing while receiving the receipt detail data from the POS terminal 2.

The embodiment of the present invention as described above, is applicable not only to receipts but also to other ticket issuance sheets such as train tickets, airplane tickets and entrance tickets. Also, the printing medium is not limited to paper sheets but may be sheets of other materials such as plastics. Furthermore, it is possible to increase the gradation number by increasing the number of bits of the gradation data.

Although the printing system using a thermal printer has been described, this is offered by way of illustration only.

EXEMPLARY ADVANTAGES OF THE INVENTION

As has been described in the foregoing, with the printing system using a thermal printer according to the present invention, the following pronounced advantages are obtainable.

(1) In the prior art gradation system, due to the area gradation it has been difficult to provide gradation to the background data superimposed on the receipt detail data. In contrast, the density gradation system permits ready printing of the background data in superimposition on the receipt detail data.

(2) It is possible to print receipt stamps by the density gradation system. With the prior art area gradation system, it has been difficult to print small size letter rows and fine images as background data. The density gradation system permits the printing.

(3) With the prior art area gradation system, it has been difficult to print small size letter rows and fine images as background data. The density gradation system permits the printing.

(4) Since the background data is stored on the printer side, no background data need be transmitted. Since the data transmission time is thus reduced, it is thus possible to improve the printing rate when making the printing while receiving data.

(5) In order to perform printing with the background data arranged such as not be parallel to the receipt detail letter data to let the same data to be readily visible, it has been necessary to re-register the background data along with the receipt detail letter rows. However, rotating once registered data makes it unnecessary the provision of a memory for registering a plurality of data pieces as well as re-registering.

(6) Since the direction of the background data can be changed in conformity to the direction of receipt letters, shop marks as background data can be read out in conformity to the direction of the letters.

What is claimed is:

1. A printing system using a thermal printer having a matrix array of color generation dots for printing basic data and background data in superimposition on each other in the thermal printer, wherein: data representing density gradation values are supplied to each color generation dot to let the background data be printed with a density lower than the density of the basic data.

2. The printing system using a thermal printer according to claim 1, wherein the direction of the background data is set to a direction different from the direction of array of the basic data.

3. The printing system using a thermal printer according to claim 2, wherein the direction of the background data is set to a direction different by 90 degrees from the direction of array of the basic data.

4. The printing system using a thermal printer according to claim 1, wherein the background data is registered as data of a predetermined gradation number in the printer for printing with a predetermined density on the basis of the density of the basic data.

5. The printing system using a thermal printer according to claim 1, wherein the printing is performed by a printer in a POS terminal.

6. The printing system using a thermal printer according to claim 1, wherein the printing is made on receipts, train tickets, airplane tickets or entrance tickets.

7. The printing system using a thermal printer according to claim 2, wherein the background data is registered as data of a predetermined gradation number in the printer for printing with a predetermined density on the basis of the density of the basic data.

8. The printing system using a thermal printer according to claim 3, wherein the background data is registered as data of a predetermined gradation number in the printer for printing with a predetermined density on the basis of the density of the basic data.

9. The printing system using a thermal printer according to claim 2, wherein the printing is performed by a printer in a POS terminal.

10. The printing system using a thermal printer according to claim 3, wherein the printing is performed by a printer in a POS terminal.

11. The printing system using a thermal printer according to claim 4, wherein the printing is performed by a printer in a POS terminal.

12. The printing system using a thermal printer according to claim 2, wherein the printing is made on receipts, train tickets, airplane tickets or entrance tickets.

13. The printing system using a thermal printer according to claim 3, wherein the printing is made on receipts, train tickets, airplane tickets or entrance tickets.

14. The printing system using a thermal printer according to claim 4, wherein the printing is made on receipts, train tickets, airplane tickets or entrance tickets.

15. The printing system using a thermal printer according to claim 5, wherein the printing is made on receipts, train tickets, airplane tickets or entrance tickets.

* * * * *